US009526284B2

(12) United States Patent
Graves et al.

(10) Patent No.: US 9,526,284 B2
(45) Date of Patent: Dec. 27, 2016

(54) INTEGRATED DEFENSE GARMENT

(71) Applicants: Elissa M. Graves, Glendale, AZ (US); Kyle W. Graves, Glendale, AZ (US)

(72) Inventors: Elissa M. Graves, Glendale, AZ (US); Kyle W. Graves, Glendale, AZ (US)

( * ) Notice: Subject to any disclaimer, the term of this patent is extended or adjusted under 35 U.S.C. 154(b) by 0 days.

(21) Appl. No.: 14/718,552

(22) Filed: May 21, 2015

(65) Prior Publication Data

US 2015/0338188 A1 Nov. 26, 2015

Related U.S. Application Data

(60) Provisional application No. 62/002,900, filed on May 25, 2014.

(51) Int. Cl.

| | |
|---|---|
| ***A41D 27/20*** | (2006.01) |
| ***A41D 13/00*** | (2006.01) |
| ***F41C 33/02*** | (2006.01) |
| ***A41B 9/00*** | (2006.01) |
| ***F41C 33/04*** | (2006.01) |

(52) U.S. Cl.

CPC ..... *A41D 27/205* (2013.01); *A41B 9/00* (2013.01); *A41D 13/0012* (2013.01); *A41D 27/20* (2013.01); *F41C 33/02* (2013.01); *F41C 33/048* (2013.01)

(58) Field of Classification Search

CPC ... A41C 33/02; A41C 33/0209; A41C 33/048; A41B 9/00; A41D 27/20; A41D 27/205

USPC ..... 2/250; 450/150

See application file for complete search history.

(56) References Cited

U.S. PATENT DOCUMENTS

| | | | | |
|---|---|---|---|---|
| 7,631,368 | B1 * | 12/2009 | Samson | F41C 33/02 2/115 |
| 9,060,555 | B1 * | 6/2015 | Harris | A41D 27/20 |
| 2006/0253963 | A1 * | 11/2006 | Limbaugh | A41D 27/208 2/247 |
| 2014/0021235 | A1 * | 1/2014 | Hunter | F41C 33/02 224/587 |

* cited by examiner

*Primary Examiner* — Anna Kinsaul
*Assistant Examiner* — Heather Mangine
(74) *Attorney, Agent, or Firm* — Kyle W. Graves

(57) ABSTRACT

An integrated defense garment may have an undergarment and may have a holster. The holster may have an affixment apparatus and a defensive device retention apparatus. The affixment apparatus may be connected in mechanical communication with the undergarment and the defensive device retention apparatus may be in mechanical communication with the affixment apparatus. In this manner, a defensive device may be concealed under clothing in a holster of an integrated defense garment.

3 Claims, 19 Drawing Sheets

SECTION A-A

SECTION A-A

INTEGRATED DEFENSE GARMENT

CROSS-REFERENCE TO RELATED APPLICATION

This application claims priority to, and the benefit of, U.S. Provisional Application Ser. No. 62/002,900 entitled "INTEGRATED DEFENSE GARMENT" filed on May 25, 2014, the contents of which are hereby incorporated herein by reference in their entirety for any purpose.

FIELD OF INVENTION

The present invention relates to the field of clothing. More particularly, the present invention relates to clothing having an integrated holster.

BACKGROUND OF INVENTION

Holsters are often worn to hold a weapon, such as a firearm, electrical stun device, or chemical dispensing device. Moreover, holsters are often worn to hold electronic devices, such as cell phones. Holsters are typically worn inside or outside of the clothing. Frequently, an individual desires to wear undergarments beneath his or her clothing as well as a holster inside of the clothing. However, clothing is often too tight to permit discrete concealment of a separate holster. Thus, there is a need for an undergarment having an integrated holster.

SUMMARY OF THE INVENTION

An integrated defense garment is disclosed. The garment may include a holster. The holster may include an affixment apparatus, and a defensive device retention apparatus. The defensive device retention apparatus may be connected to the affixment apparatus, and the affixment apparatus may be configured to retain the integrated defense garment in mechanical connection to an undergarment. The undergarment may include shapewear. The shapewear may include a first layer and a second layer. The defensive device retention apparatus may be disposed between the first layer and the second layer.

The holster may include a flat-mount holster having an inner layer and an outer layer. The flat-mount holster may also have a layer seam including stitching joining the inner layer and the outer layer together.

In various embodiments, the affixment apparatus includes a boundary seam disposed proximate to the edge of at least one of the outer layer and the inner layer. The boundary seam may follow a path forming a zig-zag extending across the edge of at least one of the outer layer and the inner layer. The path may be bounded by a holster attachment line and an undergarment attachment line. The holster attachment line may transit the surface of the outer layer, and the undergarment attachment line may transit the surface of the undergarment. The undergarment attachment line and the holster attachment line may include parallel lines. The undergarment attachment line and the holster attachment line may include arcuate lines. The affixment apparatus may include a glue layer disposed between the defensive device retention apparatus and the undergarment. The flat-mount holster may include a glue layer disposed between the inner layer and the outer layer and joining the inner layer and the outer layer together. In various embodiments, the path is configured to provide a tension distribution pattern. The tension distribution pattern may ameliorate tension concentrations in the boundary seam.

An integrated defense garment is provided. The integrated defense garment may include an undergarment including shapewear having a first layer and a second layer, and a holster having an affixment apparatus and a defensive device retention apparatus. The affixment apparatus may be mechanically connected to at least one of the first layer and the second layer, and the defensive device retention apparatus may be connected to the affixment apparatus. In various embodiments, the affixment apparatus is disposed between the first layer and the second layer.

A method of making an integrated defense garment is disclosed. The method may include joining a holster having an affixment apparatus and a defensive device retention apparatus to an undergarment including shapewear. The method may include bonding the affixment apparatus to the undergarment, and retaining a defensive device retention apparatus in connection with the affixment apparatus. In various embodiments of the method, the shapewear has a first layer and a second layer. In such embodiments, the joining may include inserting the affixment apparatus between the first layer and the second layer. In various embodiments of the method, the bonding includes at least one of gluing and sewing.

Moreover, the method may include stitching a layer seam to join an inner layer and an outer layer of the holster together, wherein the holster is a flat-mount holster including the inner layer and the outer layer. The joining may include stitching a boundary seam disposed proximate to the edge of at least one of the outer layer and the inner layer.

In various embodiments, the boundary seam follows a path including a zig-zag extending across the edge of at least one of the outer layer and the inner layer. The path may be bounded by a holster attachment line and an undergarment attachment line. The holster attachment line may transit the surface of the outer layer, and the undergarment attachment line may transit the surface of the undergarment.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction. As used herein, mechanical communication means any joint, connection, bond, or arrangement whereby an article is held, retained, or fixed in relatively static spatial relationship to another article.

Figure 1:
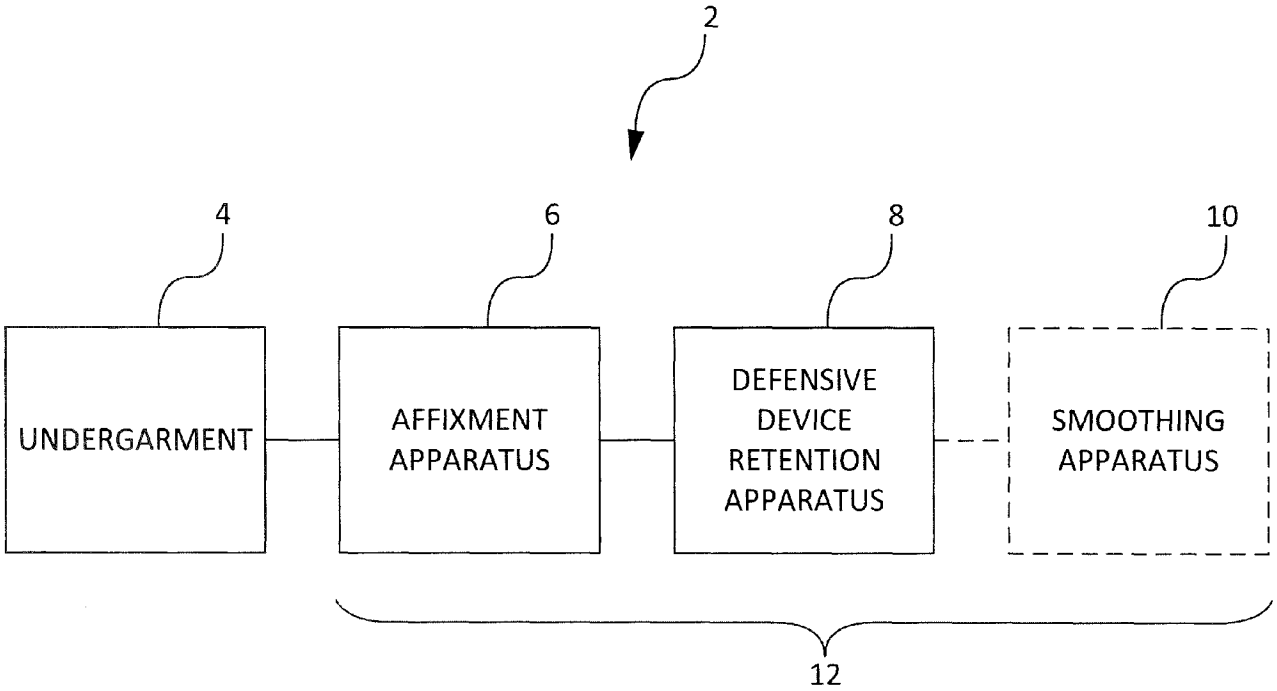
FIG. 1 is a block diagram of an example embodiment of an integrated defense garment.

Now, with reference to FIG. 1, a block diagram of an example integrated defense garment 2 is provided. An integrated defense garment 2 may comprise an undergarment 4, and a holster 12. The holster 12 may be in mechanical communication with the undergarment 4. For example, the holster may be sewed, glued, woven, snapped, zippered, integrated or otherwise attached or connected to the undergarment 4.

An integrated defense garment 2 may comprise an undergarment 4. For example, in some embodiments, the undergarment 4 may be shapewear. In other embodiments, the undergarment 4 may be underwear. Moreover, the undergarment 4 may be any article of clothing, for example, clothing worn beneath at least one other article of apparel. In various embodiments, the undergarment 4 may comprise a portion of another garment, such as a dress, a slip, athletic shorts, including running shorts, bicycle shorts, and/or the like. The undergarment 4 may comprise a compressive material and/or an elastic material, such as a polyurethane-polyurea copolymer, for example, spandex, and/or, plastic, elastic, rubber, synthetic materials, natural materials, and/or blended materials. The undergarment 4 may comprise one or more materials, or may comprise a mixture of materials or types of material or layers of material. Thus, while it may be said that the undergarment 4 may comprise shapewear, it may also be said that an undergarment 4 may comprise underwear, for example, panties, boxers, briefs, slips, and/or the like.

An integrated defense garment 2 may comprise a holster 12. A holster 12 may comprise a same material as an undergarment 4, or may comprise a different material. The holster 12 may comprise durable materials configured to retain a defensive device. For example, a holster may comprise a compressive material and/or an elastic material, such as a polyurethane-polyurea copolymer, for example, spandex, and/or, plastic, elastic, rubber, synthetic materials, natural materials, and/or blended materials. The holster may cover all or part of a defensive device; for example, the holster may retain a firearm, yet permit a sufficient portion of the firearm to be uncovered so that the firearm may be removed. The holster may further have flaps, tabs, snaps, zippers, and/or the like. In this manner, the holster may permit a defensive device to be selectively retained, and to be selectively removed from the holster 12.

Having discussed an integrated defense garment 2 generally, attention is directed to various aspects of an undergarment 4. With reference to FIGS. 1-14, an undergarment 4 may comprise a first layer 14 and a second layer 16. A first layer 14 may comprise a piece of fabric, or other material. Similarly, a second layer 16 may comprise a piece of fabric, or other material. A layer may have other elements integrated into it, for example, snaps, zippers, tabs, buttons, and/or the like.

Having discussed an undergarment 4, attention is directed in detail to various aspects of a holster 12. A holster 12 may comprise one or more pieces integrated with the undergarment 4. Alternatively, a holster 12 may be made separately from the undergarment 4 and attached thereto. As previously referenced, a holster 12 may comprise an affixment apparatus 6, and a defensive device retention apparatus 8. Moreover, the holster 12 in some embodiments may comprise a smoothing apparatus 10. The affixment apparatus 6 may connect the holster 12 to the undergarment 4, maintaining mechanical communication between the holster 12 and the undergarment 4. The defensive device retention apparatus 8 may comprise an apparatus configured to retain a defensive device or weapon, such as a firearm, a baton, a stun gun, chemical dispensing device such as pepper spray, an alarm, a knife, or another defensive device or weapon. The smoothing apparatus 10 may be disposed over a defensive device to conceal its presence or its characteristics. In various embodiments, the holster 12 may also comprise a holster location, as will be discussed further herein with respect to FIGS. 6-7.

An affixment apparatus 6 may comprise any mechanism by which the holster 12 is retained in connection to the undergarment 4. For example, the affixment apparatus 6 may comprise tabs and slots, or may comprise stitches, glue, weaving, snaps, zippers, or may comprise an integrated material layer disposed within or between portions of an undergarment 4. For example, FIGS. 1-5, 11A, and 12-14 disclose various example embodiments of affixment apparatuses 6 as will be discussed further herein. Moreover, an affixment apparatus 6 may be selectably affixable, such as comprising buttons and button holes, or hook and loop fasteners, or snaps, and/or the like.

With reference to FIGS. 1 and 3-5, a defensive device retention apparatus 8 may comprise any mechanism by which a defensive device is retained in connection to the holster 12. For example, a defensive device retention apparatus 8 may comprise a sewn tube, or a shaped rigid or semi-rigid member, such as a polycarbonate sheath shaped to receive a defensive device. A defensive device retention apparatus 8 may comprise sewn layers, or may comprise an integrated pocket layered within other elements of an integrated defense garment 2. A defensive device retention apparatus 8 may further comprise flaps, closures, and/or other mechanisms whereby at least a portion of the holster 12 may be selectably closable. For instance, a flap having a snap may be disposed to cover an opening of the holster 12.

With reference to FIGS. 1, 3, 4, 10, and 11, a smoothing apparatus 10 may comprise any mechanism by which the presence or characteristics of the defensive device may be concealed. Thus, as one may appreciate, a smoothing apparatus 10 (as well as a defensive device retention apparatus 8 and/or an affixment apparatus 6 and/or a holster 12) may not comprise separate components, but may be combined, or may be made of shared components, such as shared layers of fabric. For example, a holster 12 may comprise a defensive device retention apparatus 8 comprising elastic cloth and the smoothing apparatus 10 may comprise the same piece of elastic cloth, thus the same component may serve multiple functions, such as smoothing and also retention. In further embodiments, a smoothing apparatus 10 may comprise a stiffening layer and/or a thickening layer, for example, a piece of plastic, rubber, fabric, and/or any other apparatus by which the presence or characteristics of the defensive device may be concealed.

Figure 2:
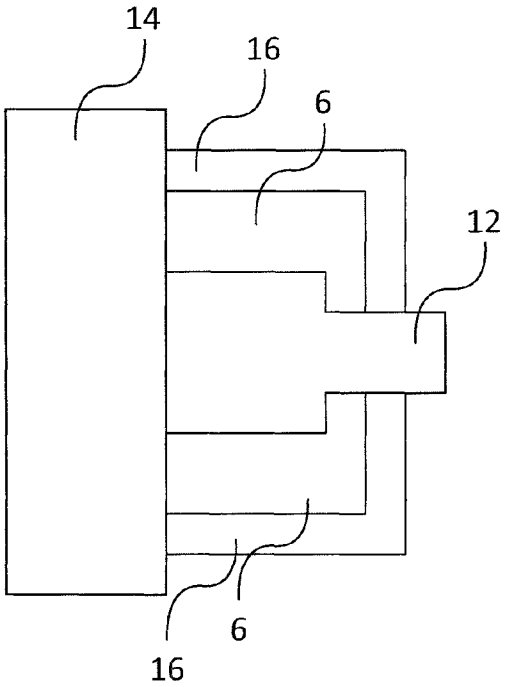
FIG. 2-5 are side views of various block diagrams of various aspects of various example embodiments of integrated defense garment.
Figure 3:
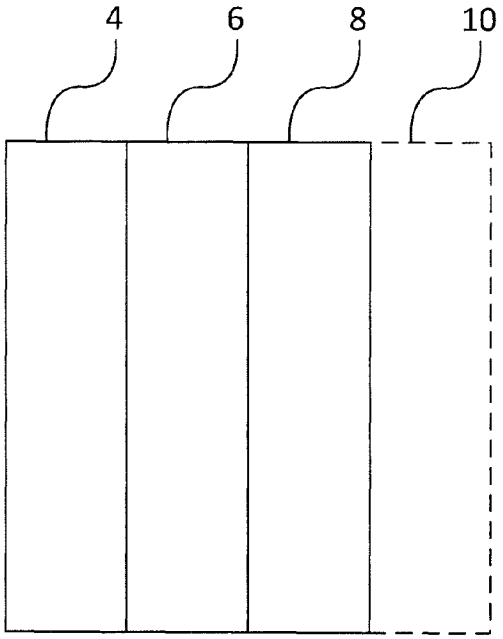

With reference to FIGS. 1 and 2, in various embodiments, an integrated defense garment 2 may comprise various arrangements of undergarment 4, the first layer 14 and the second layer 16 of the undergarment 4 and the holster 12. For example, a holster 12 may be disposed between the first layer 14 and the second layer 16 of the undergarment 4. Because the first layer 14 and the second layer 16 may be connected at various points, this arrangement retains the holster in mechanical communication with the undergarment 4. An affixment apparatus 6 may be disposed between and/or about a portion of the holster 12 and may further improve the retention of the holster 12 to the undergarment 4. For example, an affixment apparatus 6 may comprise a stiffening layer of material, or may comprise a glue, or may comprise stitching, or may comprise any other apparatus having a bond or connection to both the undergarment 4 and the holster 12 and/or otherwise increasing the frictional interaction between the undergarment 4 and the holster 12.

With reference to FIG. 1, 3, 11A-B, in various embodiments, an integrated defense garment 2 may comprise various arrangements of undergarment 4, and the affixment apparatus 6, the defensive device retention apparatus 8, and optionally, the smoothing apparatus 10 of the holster 12. For example, the defensive device retention apparatus 8 may be connected, bonded, or otherwise in mechanical communication with the affixment apparatus 6. The affixment apparatus 6 may comprise a layer between the defensive device retention apparatus 8 and the undergarment 4. For instance, the affixment apparatus 6 may comprise a boundary seam 11 (FIG. 11B) around the boundary of the defensive device retention apparatus 8 and holding it to the undergarment 4. The boundary seam 11 may comprise a straight stitch, or a zig-zag stitch, or a plurality of stitches, and/or the like. The boundary seam 11 may overlap the edge of the defensive device retention apparatus 8, such as a zig-zag stitch with each side of the zig-zag overlapping the edge of the defensive device retention apparatus 8 so that the stitch alternately penetrates the undergarment 4, and the undergarment 4 plus defensive device retention apparatus 8. In this manner, the edge of the defensive device retention apparatus 8 may be more smoothly pressed against the undergarment 4. Furthermore, the affixment apparatus 6 may comprise an edge portion of the defensive device retention apparatus 8 which penetrates into the undergarment 4 or connects thereto. The affixment apparatus 6 may comprise a glue layer, such as a first glue layer 45-1 (FIG. 11B) or any other layer positioned between the undergarment 4 and the defensive device retention apparatus 8. In various embodiments, a smoothing apparatus 10 may be disposed at or proximate to the outermost portions of the defensive device retention apparatus 8.

Figure 4:
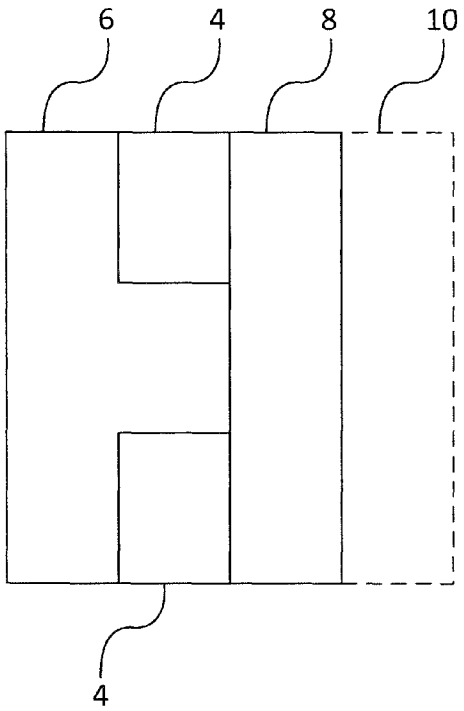

With particular focus on FIG. 4, in various embodiments, an integrated defense garment 2 may comprise various arrangements of undergarment 4, and the affixment apparatus 6, the defensive device retention apparatus 8, and optionally the smoothing apparatus 10 of the holster 12. For example, the defensive device retention apparatus 8 may be connected, bonded, or otherwise in mechanical communication with the affixment apparatus 6. The affixment apparatus 6 may penetrate through an aperture in the undergarment 4 and may comprise an enlarged portion disposed inside of the undergarment 4 whereby the affixment apparatus 6 cannot be pulled through the aperture in the undergarment 4. In other embodiments, the affixment apparatus 6 may comprise a button which may extend through an opening in the undergarment 4, but may be twisted to enable it to be pulled through the aperture in the undergarment 4. In various embodiments, the affixment apparatus 6 may also comprise a boundary seam 11 (FIG. 11B) around the boundary of the defensive device retention apparatus 8 and holding it to the undergarment 4. The boundary seam 11 (FIG. 11B) may comprise a straight stitch, or a zig-zag stitch, or a plurality of stitches, and/or the like. The boundary seam 11 (FIG. 11B) may overlap the edge of the defensive device retention apparatus 8, such as a zig-zag stitch with each side of the zig-zag overlapping the edge of the defensive device retention apparatus 8 so that the stitch alternately penetrates the undergarment 4, and the undergarment 4 plus defensive device retention apparatus 8. In this manner, the edge of the defensive device retention apparatus 8 may be more smoothly pressed against the undergarment 4. Furthermore, the affixment apparatus 6 may also comprise an edge portion of the defensive device retention apparatus 8 which penetrates into the undergarment 4 or connects thereto. The affixment apparatus 6 may also comprise a glue layer, such as a first glue layer 45-1 (FIG. 11B) or any other layer positioned between the undergarment 4 and the defensive device retention apparatus 8. In various embodiments, a smoothing apparatus 10 may be disposed at the outermost portion of the defensive device retention apparatus 8.

Figure 5:
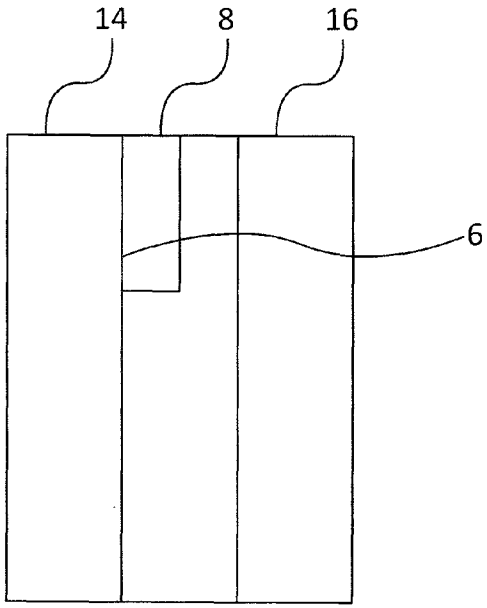

Turning now to FIG. 5, in various embodiments, an integrated defense garment 2 may comprise various arrangements of undergarment 4 comprising a first layer 14 and a second layer 16, the affixment apparatus 6, the defensive device retention apparatus 8, and optionally, the smoothing apparatus 10 of the holster 12. For example, the defensive device retention apparatus 8 may be inserted between the first layer 14 and the second layer 16 of the undergarment 4. An affixment apparatus 6 may comprise the frictional interlock occurring between first layer 14 and the defensive device retention apparatus 8 and between the second layer 16 and the defensive device retention apparatus 8. However, the affixment apparatus 6 may also comprise any connection, bonding, stitching, gluing, or other joining device holding the defensive device retention apparatus 8 in mechanical communication with the undergarment 4. In various embodiments, only a portion of the defensive device retention apparatus 8 extends between the first layer 14 and the second layer 16, for example, an edge portion of the defensive device retention apparatus 8 may penetrate into the undergarment 4 or connect thereto.

Figure 6:
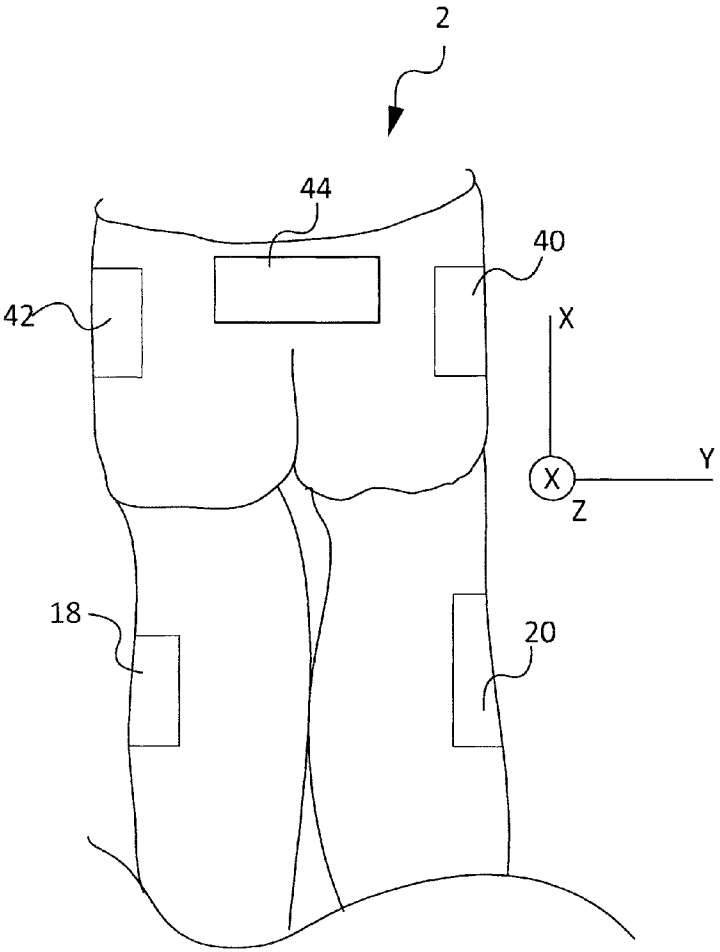
FIGS. 6-7 are views of various example holster locations of example holsters in accordance with various example embodiments of an integrated defense garment.

Turning now to FIG. 6, a holster 12 may be disposed at various locations on a back of an undergarment 4. For example, a holster 12 may be positioned at a location comprising a left hip 42. A holster 12 may be positioned at a location comprising a right hip 40. A holster 12 may be positioned on an upper (in the positive-X direction) backside (in the negative-Z direction) portion of an undergarment 4, for example, a holster at the small of a user's back. A holster 12 may be disposed on a location comprising a left side area 18 and/or a right side area 20.

Figure 7:
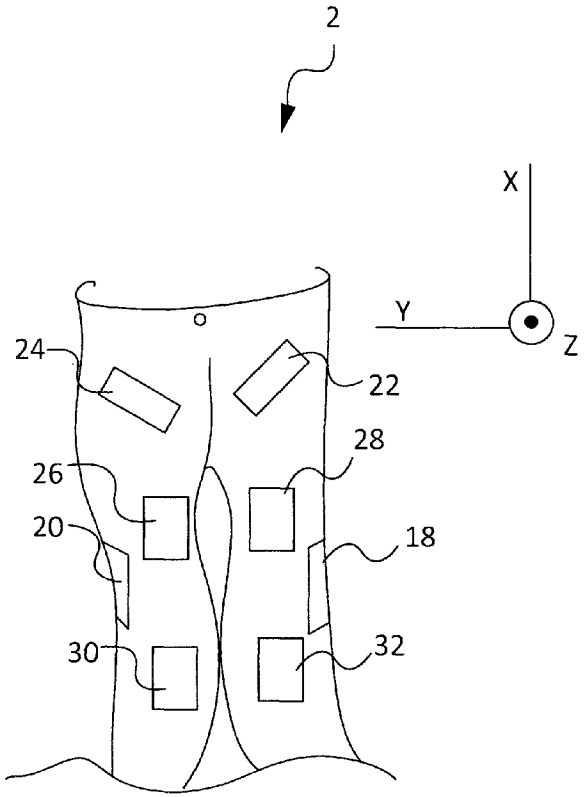

Turning now to FIG. 7, a holster 12 may be positioned at various locations on the front of an undergarment 4. For instance, a holster 12 may be positioned on a left crotch area 22. A holster 12 may be positioned on a right crotch area 24. A holster 12 may be positioned on an upper (in the positive-X direction) portion of a user's thigh, such as left upper thigh area 28 and/or right upper thigh area 26. A holster 12 may be positioned on a lower (in the negative-X direction) portion of a user's thigh, such as left lower thigh area 32 and/or right lower thigh area 30.

Moreover, a holster 12 may be positioned on the sides of an undergarment 4. For example, a holster 12 may be positioned on a left side area 18, or on a right side area 20 of an undergarment 4.

As one may appreciate, a holster 12 may be positioned on any portion of an undergarment 4 arranged to permit a wearer to reach a defensive device disposed in the holster 12. Moreover, an integrated defense garment 2 may comprise more than one holster. For example, holsters may be located at corresponding left and right side areas, for example, to permit ambidextrous use, or holsters may be located at various different areas to permit greater versatility and permit a user to carry multiple defensive devices or to select from among different locations, for example, depending on the convenience of access and degree of concealment desired in view of the other articles of clothing a user may be wearing. Moreover, a holster 12 may be selectably removable and refixable in different locations, such as by hook and loop fasteners, buttons and button holes, zippers, snaps, and/or the like.

Figure 8:
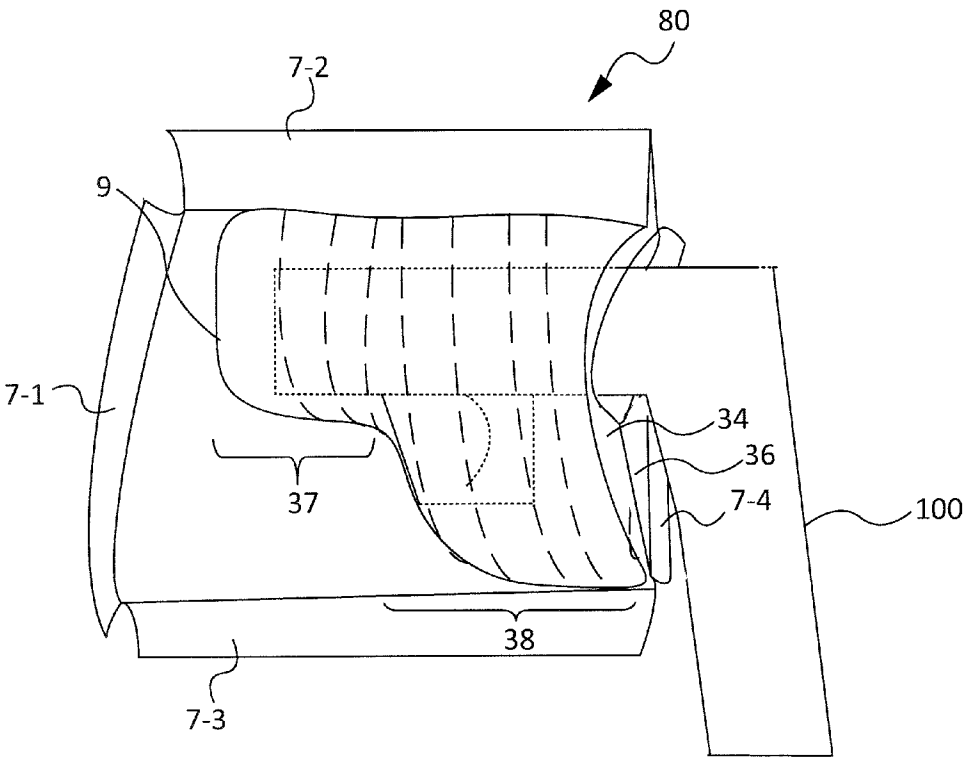
FIGS. 8-11B are views of various example embodiments of integrated defense garments.

With reference to FIGS. 1 and 8, a holster may comprise a tabbed holster 80. A tabbed holster 80 may comprise a barrel pocket 37, a trigger pocket 38, and a layer seam 9. Thus, the tabbed holster 80 may be shaped to conform to the profile of a firearm. The holster may further comprise an affixment apparatus 6 comprising a first tab 7-1, a second tab 7-2, a third tab 7-3, and a forth tab 7-4. These tabs 7-1, 7-2, 7-3, 7-4 may interface with the undergarment 4 in the same way, or in different ways, in accordance with the prior discussion herein. In various embodiments, each tab is sewed or glued to the undergarment 4, or is inserted between layers thereof.

The barrel pocket 37 may comprise a portion of the holster having an opening shaped to permit the barrel portion of a defensive device 100 such as a firearm to fit therein and shaped to generally conform to the profile of the barrel to enhance the frictional retention of the defensive device 100 and to keep the defensive device 100 at a substantially fixed orientation within the holster.

The trigger pocket 38 may comprise a portion of the holster having an opening shaped to permit the trigger guard portion of a defensive device 100, such as a firearm to fit therein and shaped to generally conform to the profile of the trigger guard to enhance the frictional retention of the defensive device 100 and to keep the defensive device 100 at a substantially fixed orientation within the holster.

The barrel pocket 37 and the trigger pocket 38 may be formed from an outer layer 34 of holster material and an inner layer 36 of holster material. Holster material may comprise fabric, plastic, or any other material. Thus, the barrel pocket 37 may be formed from two pieces of material stitched together. Alternatively, a single piece of material may be folded to form an outer layer 34 and an inner layer 36 and stitched together. The outer layer 34 and the inner layer 36 may be stitched along a layer seam 9. The layer seam 9 may comprise a profile of the defensive device 100 desired to be retained in the holster, for example, a firearm. The layer seam 9 may comprise an enlarged profile of the defensive device 100, or a profile enlarged in one direction, or in multiple directions as desired to retain a defensive device 100 in view of the stretch, elasticity, and/or other material properties of the holster material and material of the undergarment. The layer seam 9 may coincide with an affixment apparatus 6 so as to also comprise a boundary seam 11 (FIG. 11B) of an affixment apparatus 6, or may be set inward (e.g., closer to defensive device 100) or may be set outward (e.g., farther from defensive device 100) of the boundary seam 11 (FIG. 11B) of the affixment apparatus 6. Furthermore, the layer seam 9 may be supplemented or supplanted by a glue layer such as second glue layer 45-2 disposed between the outer layer 34 and the inner layer 36. Moreover, the layer seam 9 (and/or boundary seam 11 (FIG. 11B)) may have a seam pattern, such as straight, or zig-zag, and may be augmented and/or supplanted by glue layers 45-1, 45-2 and/or the like. Thus, with momentary reference to FIGS. 11A-B, an inner layer 36 and outer layer 34 may be stitched together at a layer seam 9, (and/or glued by second glue layer 45-2) and jointly stitched to an undergarment 4 by at least one of a boundary seam 11 comprising a path 48 and/or a first glue layer 45-1.

Figure 9:
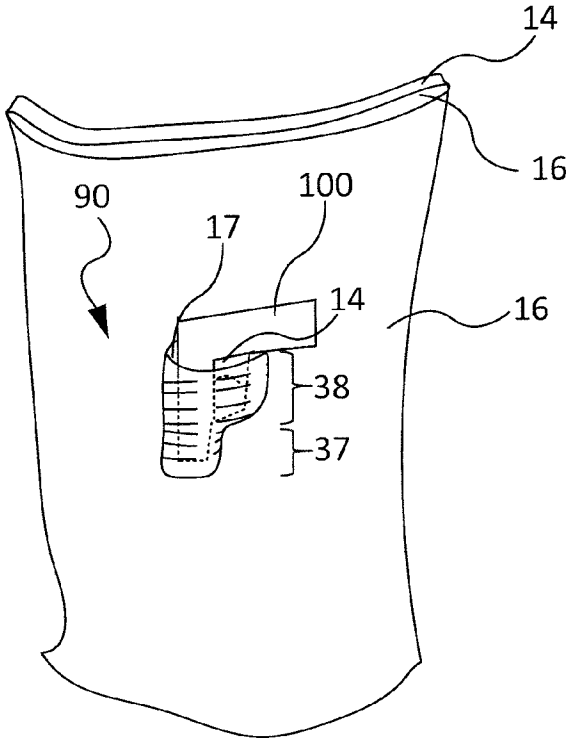

With reference to FIGS. 1 and 9, a holster may comprise an integrated holster 90. An integrated holster 90 may comprise a barrel pocket 37, a trigger pocket 38, and a layer seam 9. The integrated holster 90 may be made integrally with undergarment 4. For instance, an undergarment 4 may comprise a first layer 14 and a second layer 16. A slit may be cut in the second layer 16 so that a defensive device 100 may be inserted into an opening between the first layer 14 and the second layer 16.

The barrel pocket 37 may comprise a portion of the holster having an opening shaped to permit the barrel portion of a defensive device 100, such as a firearm, to fit therein and shaped to generally conform to the profile of the barrel to enhance the frictional retention of the defensive device 100 and to keep the defensive device 100 at a substantially fixed orientation within the holster.

The trigger pocket 38 may comprise a portion of the holster having an opening shaped to permit the trigger guard portion of a defensive device 100, such as a firearm, to fit therein and shaped to generally conform to the profile of the barrel to enhance the frictional retention of the defensive device 100 and to keep the defensive device 100 at a substantially fixed orientation within the holster.

The second layer 16 and the first layer 14 of the undergarment 4 may be stitched along a layer seam 9. The layer seam 9 may comprise a profile of the defensive device 100 desired to be retained in the holster.

Figure 10:
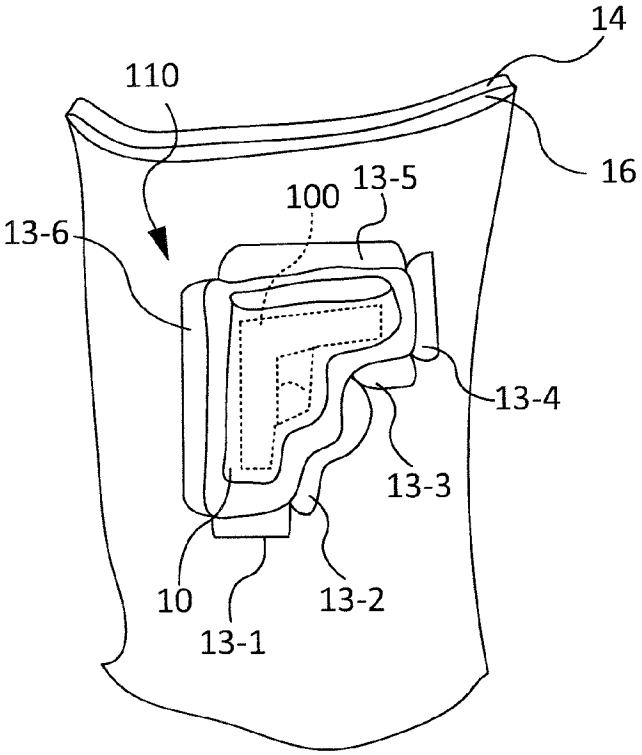

With reference to FIGS. 1 and 10, a holster may comprise a sandwich holster 110. A sandwich holster may be configured to completely cover a defensive device 100. In this manner, it may be said that the holster sandwiches the defensive device 100. For example a holster may be shaped to permit the entirety of the defensive device 100, such as a firearm, to reside within the holster, so that no portion sticks out. Thus, in this manner, the holster may comprise a smoothing apparatus 10 that completely covers and smoothes the profile of the entirety of the defensive device 100, such as a firearm. Moreover, a holster may be connected to the undergarment 4 by an affixment apparatus 6 comprising tabs 13-1 through 13-7. Thus, as one will appreciate, an affixment apparatus 6 may comprise any number of tabs. As shown in FIG. 10, each tab comprises distal convex curved edges curving away from corresponding distal convex curved edges of adjacent tabs.

Figure 11A:
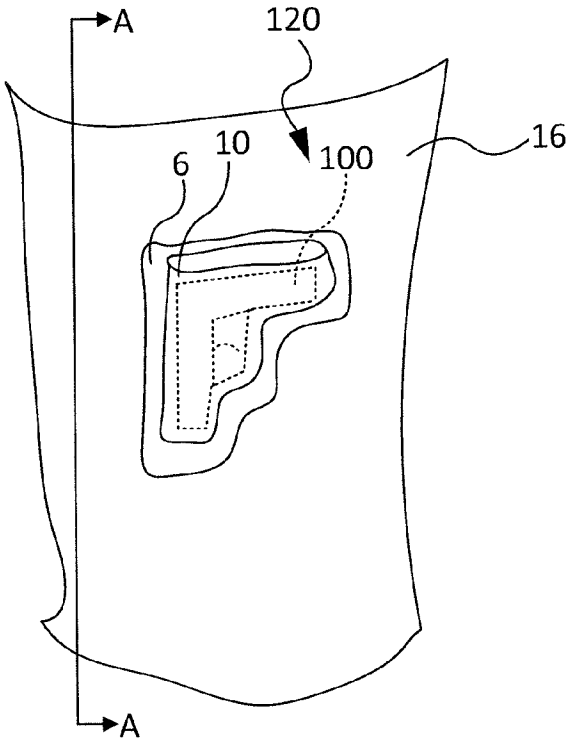
Figure 11B:
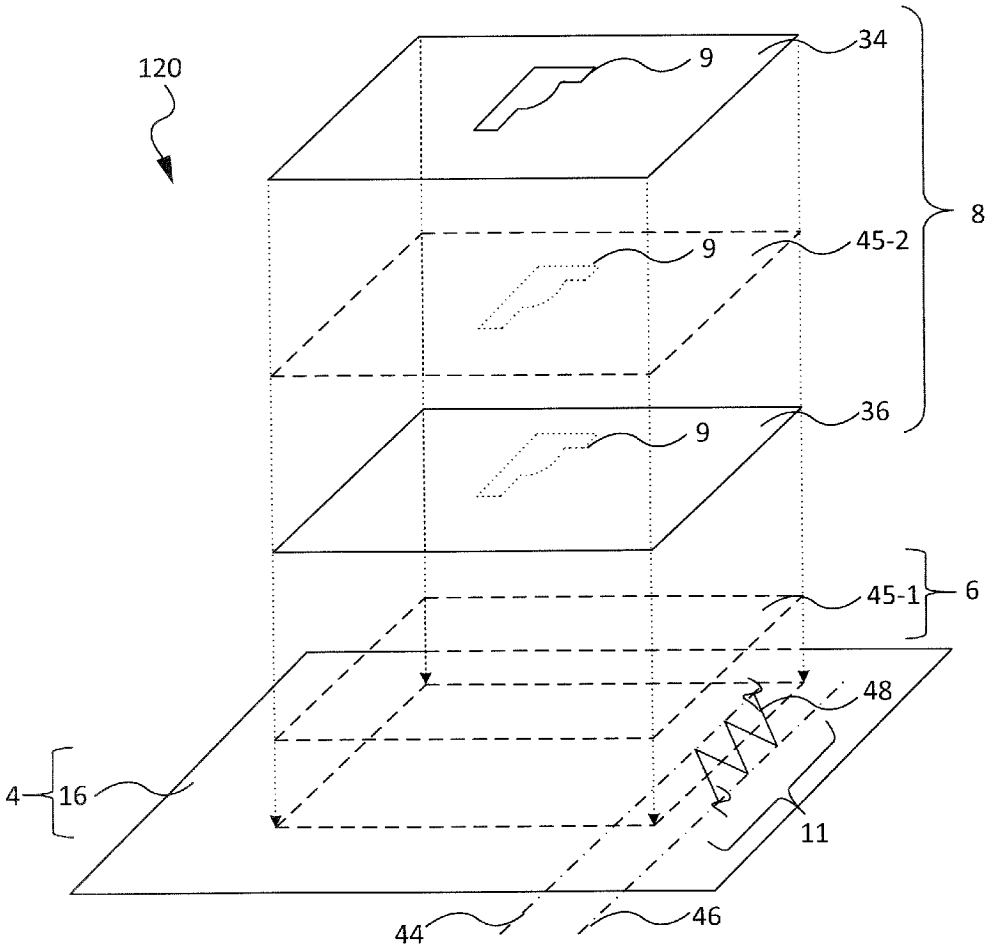

With reference to FIGS. 1 and 11A-B, a holster may comprise a flat-mounted holster 120. A flat-mounted holster 120 may be configured to mount on top of the undergarment 4. Thus, one may appreciate that a flat-mounted holster may comprise an affixment apparatus 6 comprising a continuous tab. Moreover, a flat-mounted holster may comprise an affixment apparatus 6 comprising a hook and loop fasteners, or snaps, or buttons or any other affixment apparatus 6. One may appreciate that a flat-mounted holster may be easy to reconfigure, for example, to remove and replace.

Flat-mounted holster may comprise an inner layer 36 and an outer layer 34 of holster material, or in various embodiments may comprise a single layer of holster material. Holster material may comprise fabric, plastic, or any other material. The outer layer 34 and the inner layer 36 may be stitched along a layer seam 9. The layer seam 9 may comprise a profile of the defensive device 100 desired to be retained in the holster, for example, a firearm. The layer seam 9 may coincide with a boundary seam 11 of an affixment apparatus 6, so that shared thread forms both features. In further embodiments, the layer seam 9 may be set inward (e.g., closer to defensive device 100) or may be set outward (e.g., farther from defensive device 100) of the boundary seam 11. Moreover, the layer seam 9 (and/or boundary seam 11) may have a path 48, such as straight, or zig-zag, and may be augmented and/or supplanted by glue layer 45-1, 45-2 and/or the like. Thus, an inner layer 36 and outer layer 34 may be stitched together at a layer seam 9 and jointly stitched to an undergarment 4 by at least one of a boundary seam 11 comprising a path 48 and optionally a first glue layer 45-1, and/or a second glue layer 45-2. The inner layer 36 may comprise a flap, such as may selectably cover an opening between the inner layer 36 and the outer layer 34 and may be at least one of snapped, hook and loop fastened, zippered, clipped, buttoned and/or the like to the outer layer 34, such as to provide a closure whereby a defensive device 100 may be substantially enclosed within the flat-mounted holster.

First glue layer 45-1 may occupy the entire contact surface of the holster such as a flat-mounted holster 120 to the undergarment 4. In further embodiments, first glue layer 45-1 only occupies a portion of the contact surface, such as that portion proximate to the edge of the contact surface, and/or that portion proximate to the boundary seam 11. Moreover, first glue layer 45-1 may only occupy a portion of the contact surface, such as that portion outward (relative to a defensive device 100) of the boundary seam 11. Second glue layer 45-2 may occupy the entire contact surface of the inner layer 36 and the outer layer 34. In further embodiments, second glue layer 45-2 only occupies a portion of the contact surface, such as that portion proximate to the edge of the contact surface, and/or that portion proximate to the layer seam 9. Moreover, second glue layer 45-2 may only occupy a portion of the contact surface, such as that portion outward (relative to a defensive device 100) of the layer seam 9.

Path 48 may comprise a zig-zag. For instance, path 48 may comprise a zig-zag bounded by a holster attachment line 44 and an undergarment attachment line 46. The holster attachment line 44 may be a line transiting the surface of the flat-mounted holster 120 while the undergarment attachment line 46 may transit a surface of the undergarment 4. The path 48 may comprise diagonal (or other) lines alternating between the holster attachment line 44 and the undergarment attachment line 46 so that the path 48 exhibits a point of inflection at each of the holster attachment line 44 and of the undergarment attachment line 46. Thus, a thread following the path 48 may form a seam that overlaps the outer edge of the holster 12. In this manner, the holster may be permitted to stretch and to exhibit differential motion such as differential stretching relative to the undergarment 4. Moreover, the edge of the holster such as a flat-mounted holster 120 may be pressed against the undergarment 4, smoothing the holster such as a flat-mounted holster 120. As such, the smoothing apparatus 10 (FIG. 1) may comprise the boundary seam 11. The undergarment attachment line 46 and the holster attachment line 44 may be parallel lines comprising one of same and different tension distribution patterns. The undergarment attachment line 46 and the holster attachment line 44 may be arcuate lines comprising one of same and different tension distribution patterns. The undergarment attachment line 46 and the holster attachment line 44 may be a combination of parallel and/or arcuate lines comprising a combination of same and/or different tension distribution patterns.

Figure 15A:
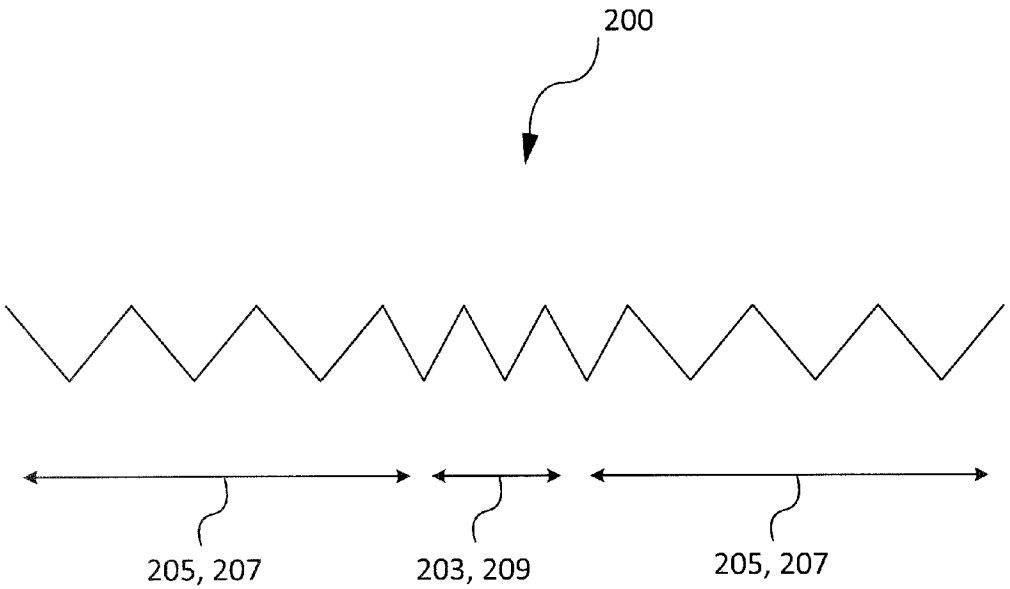
FIGS. 15A-C are views of various example tension distribution patterns having regions of different shear and/or strain reaction forces and differential stretching limits.
Figure 15B:
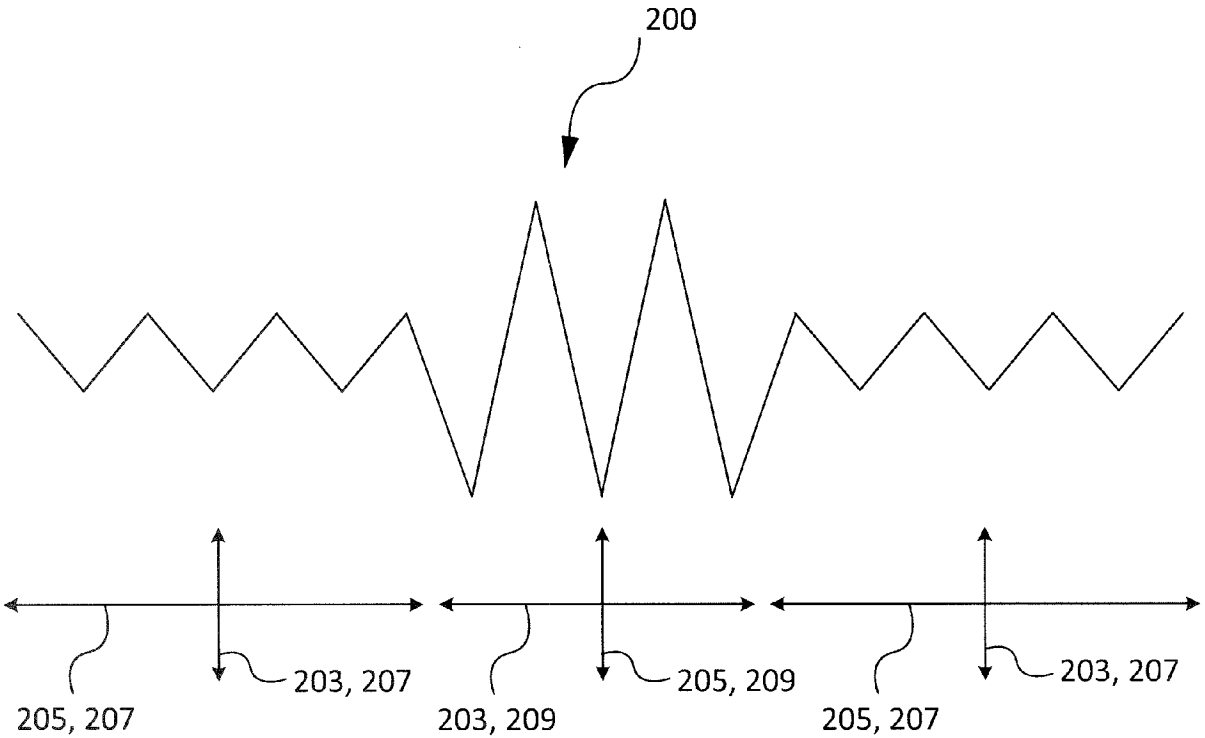
Figure 15C:
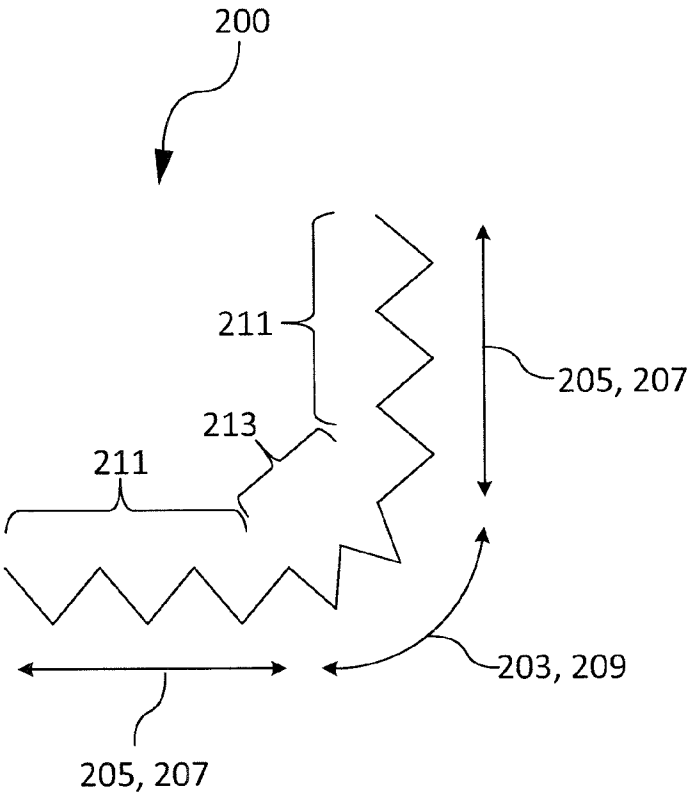

The path 48 may follow the edge of the holster such as a flat-mounted holster 120. The path 48 may also comprise reinforcement sections such as may not follow the edge of the holster such as a flat-mounted holster 120 but may extend through portions of the holster such as a flat-mounted holster 120 and not transit between holster attachment line 44 and undergarment attachment line 46, but form reinforcing stitches. The path 48 may follow the edge of the holster such as a flat-mounted holster 120 and may comprise alternating diagonal lines extending between the holster attachment line 44 and the undergarment attachment line 46 that are uniform reflections of one another. In various embodiments, the path 48 may follow the edge of the holster such as a flat-mounted holster 120 and may comprise line extending in generally alternating directions, but which are oriented to permit differential motion of the holster such as a flat-mounted holster 120 relative to the undergarment 4 along directions configured to distribute tension along the boundary seam 11 according to a tension distribution pattern, such as during usage, exercise, vigorous activity, and/or insertion of defensive devices 100, such as firearms, of various sizes. Moreover, the holster attachment line 44 and/or the undergarment attachment line 46 may comprise parallel lines, or may comprise non-parallel lines, or may comprise lines having a relative angle, or may comprise arcuate lines and/or the like. In this manner, the boundary seam 11 may be configured to distribute tension according to a tension distribution pattern. The tension distribution pattern may comprise an equal tension distribution, or may comprise the amelioration of tension concentrations, or may comprise the concentration of tension along the longer and/or more linear portions of the boundary seam 11, and/or any pattern or combination of patterns, and/or combination of patterns during different types of use, as desired. For example, with reference to FIGS. 15A-C, a tension distribution pattern 200 may comprise regions of different shear and strain reaction forces and differential stretching limits. For instance, there may be regions of greater reaction force to differential stretch 203 and regions of lesser reaction force to differential stretch 205. In various embodiments the seam may provide a reaction force countering differential stretch of the material joined by the stitch, and the control of this reaction force may enhance the tendency of the garment to lie flat under clothing, to endure motion, to securely retain defensive devices of differing sizes, and/or the like. Moreover, the seam may comprise regions of lesser ultimate stretch 207 and regions of greater ultimate stretch 209. Ultimate stretch may be the ability of the seam to withstand differential stretch without ceasing to behave elastically. For instance, upon reaching ultimate stretch, the seam may cause differential stretching to cease and the materials joined at the seam may remain relatively static. Moreover, regions of greater/lesser reaction force to differential stretch and greater/lesser ultimate stretch may have an orientation. For instance, behavior may differ along orthogonal directions, and behavior in orthogonal relations may be interrelated, such as along the length and width of a zig-zag seam. For instance, the closer stitches are in the length direction, the less ultimate stretch available in the width direction (and vis-a-versa). Similarly, the longer distance in the width direction between the terminal ends of stitches, the less reaction force (but greater ultimate stretch) available in the length direction (and vis-a-versa). In various embodiments, with reference to FIG. 15C, regions of greater reaction force 203 and/or greater ultimate stretch 209 may be coincident with corners 213 in the seam, such as arcuate bends, whereas regions of lesser reaction force 205 and/or lesser ultimate stretch 207 may be coincident with sides 211 of the seam. In various embodiments, with reference to FIG. 15A, regions of greater reaction force 203 and/or greater ultimate stretch 209 (lengthwise) may be coincident with closer (lengthwise) stitches in the seam, whereas regions of lesser reaction force 205 and/or lesser ultimate stretch 207 (lengthwise) may be coincident with longer stitches (lengthwise) of the seam. In various embodiments, with reference to FIG. 15B, regions of greater reaction force 203 and/or lesser ultimate stretch 207 (heightwise) may be coincident with shorter stitches (heightwise) in the seam, whereas regions of lesser reaction force 205 and/or greater ultimate stretch 209 (heightwise) may be coincident with taller stitches (heightwise) of the seam. Additionally, regions of greater reaction force 203 and/or greater ultimate stretch 209 (lengthwise) may be coincident with taller stitches (heightwise) and regions of lesser reaction force 205 and/or lesser ultimate stretch 207 (lengthwise) may be coincident with shorter stitches (heightwise) of the seam.

Figure 12:
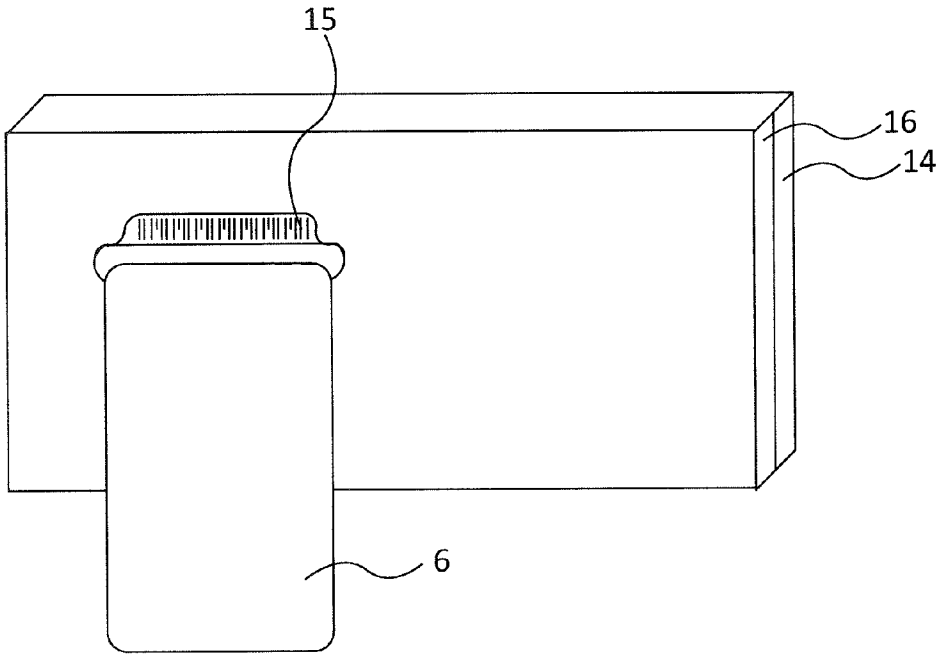
FIGS. 12-14 are various views of various example embodiments of integrated defense garments comprising various affixment apparatuses.
Figure 13:
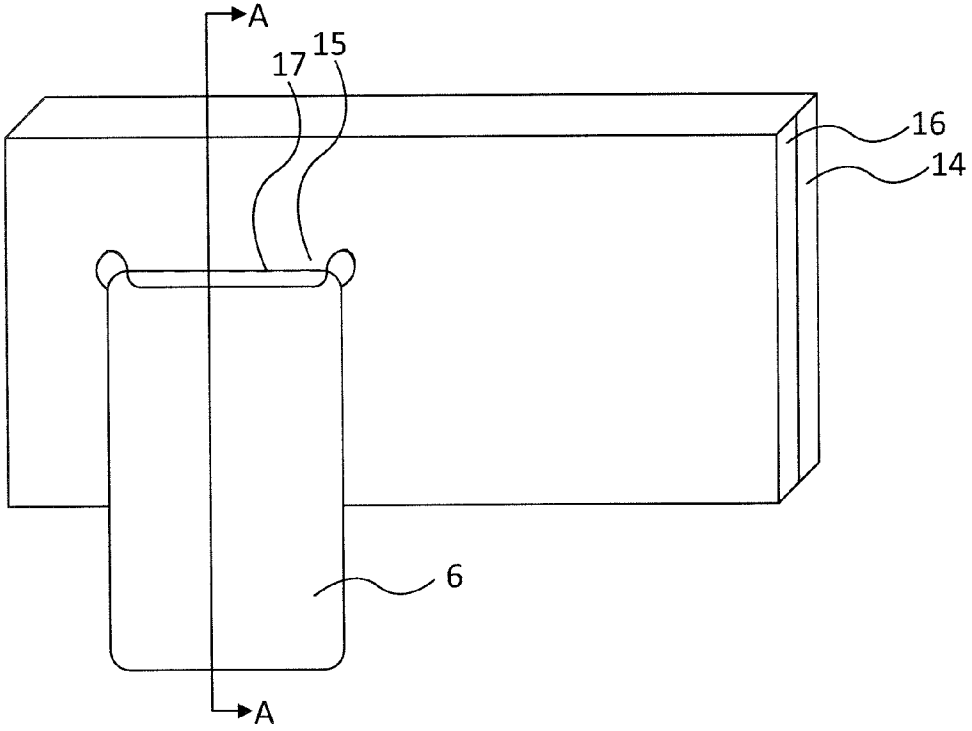
Figure 14:
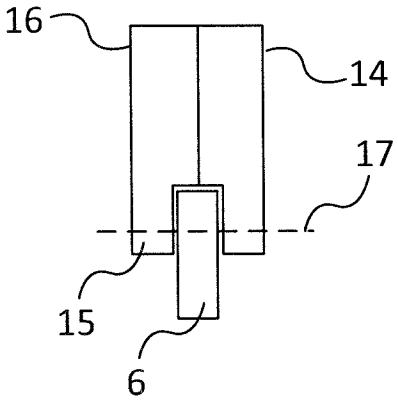

With reference to FIGS. 12-14, various views of various affixment apparatuses 6 are illustrated. While with reference to FIGS. 11A-B, an affixment apparatus 6 may comprise a continuous tab edging the flat-mount holster, an affixment apparatus 6 may comprise various configurations, or combinations of any configurations disclosed herein. For example, an affixment apparatus 6 may comprise a tab disposed between the first layer 14 and the second layer 16. The first layer 14 may be cut to permit a flap 15 to overlap the affixment apparatus 6. The flap 15 may be laid back over the affixment apparatus 6 (FIG. 13) and may be sewed, glued, or frictionally retained. For example, with reference to FIG. 14, the flap 15, the first layer 14, and the affixment apparatus 6 may be sewed along line 17. In this manner, the holster 12 may be connected to the undergarment 4.

An integrated defense garment 2 has been discussed herein with respect to shapewear for a user's lower body, such as shapewear, underwear, running shorts, athletic shorts, bicycle shorts, and/or the like. However, an integrated defense garment 2 may comprise shapewear, underwear, or other apparel for a user's upper body, for example, an undershirt, a bra, or a compression garment. Moreover, an integrated defense garment 2 may comprise an elastic band, or a belly band or any other garment configured to support a holster.

Figure 16:
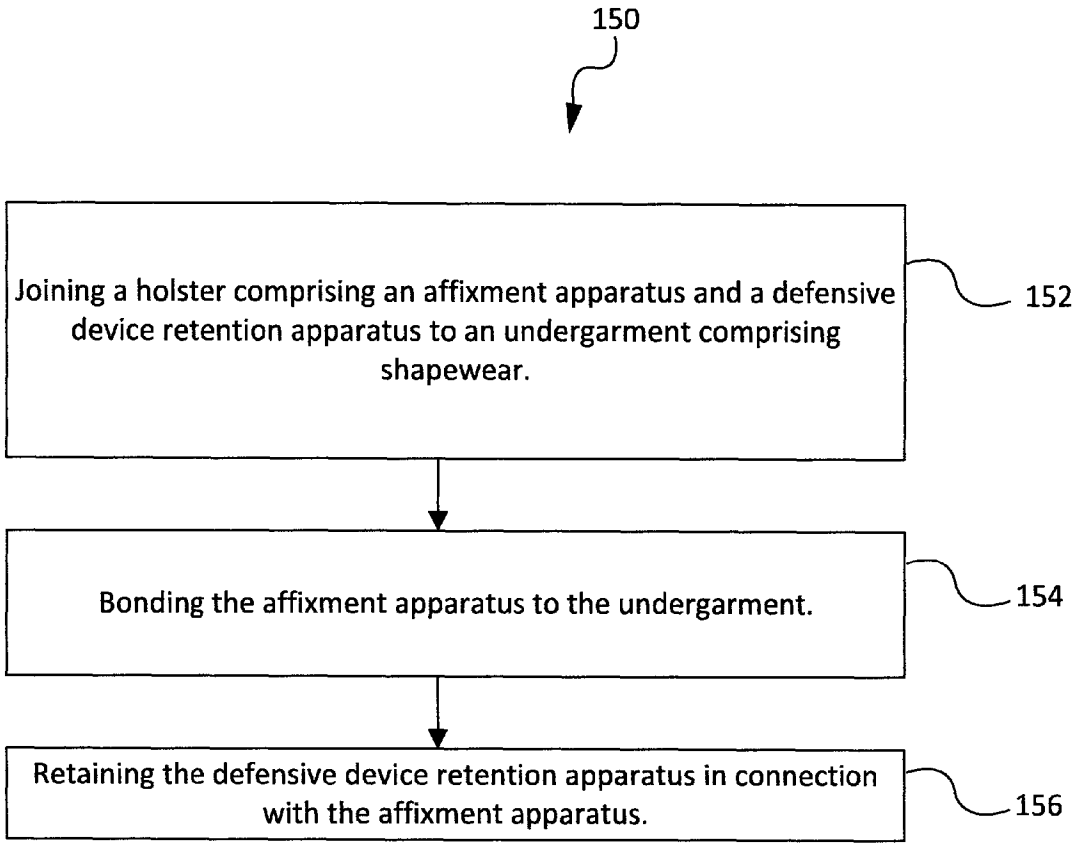
FIG. 16 is a diagram illustrating an example method of manufacturing an integrated defense garment according to various example embodiments.

With reference to FIG. 16, an integrated defense garment 2 may be manufactured according to various methods. For example, a method 150 may include joining a holster to an undergarment (Step 152). The holster may comprise an affixment apparatus and a defensive device retention apparatus, and the undergarment may comprise shapewear. The undergarment (such as shapewear) may comprise a first layer and a second layer or may comprise a single layer. The joining may comprise inserting the affixment apparatus between the first layer and the second layer and/or atop/under the undergarment (as applicable). The method may further include bonding the affixment apparatus to undergarment (Step 154). For instance, the affixment apparatus may be bonded to the first layer and/or the second layer, or the single layer (as applicable). The bonding may comprise at least one of gluing and sewing. Finally, the method 150 may include retaining a defensive device retention apparatus in connection with the affixment apparatus (Step 156).

Now, having described various components of various exemplary integrated defense garments, an integrated defense garment may be manufactured from various materials. In one exemplary embodiment, an integrated defense garment may comprise fabric. For example, an integrated defense garment may comprise fabric, such as cotton cloth, polyester cloth, a compressive material and/or an elastic material, such as a polyurethane-polyurea copolymer, for example, spandex, and/or plastic, elastic, rubber, synthetic materials, natural materials, blended materials, synthetic fiber cloth, natural fiber cloth, mixed fiber cloth, though it may alternatively comprise numerous other materials configured to provide support, such as, for example, composite, ceramic, plastics, polymers, alloys, glass, binder, epoxy, polyester, acrylic, or any material or combination of materials having a desired strength, stiffness, stretch characteristics, and/or flexibility sufficient to maintain resiliency and comfort during use. In various embodiments, various portions of integrated defense garments as disclosed herein are made of different materials or combinations of materials, and/or may comprise coatings. For example, with reference to FIG. 1, an undergarment 4 and a holster 12 may comprise different materials.

In various embodiments, an integrated defense garment may comprise multiple materials, or any material configuration suitable to enhance or reinforce the resiliency and/or support of the integrated defense garment when subjected to wear in a use environment or to satisfy other desired biological, chemical, or physical properties, for example sweat wicking, speed of drying, elasticity, load capacity, rigidity, heat tolerance, size, antibacterial characteristics, antimicrobial characteristics, spring constant, or stretch length.

The present disclosure has been described with reference to various embodiments. However, one of ordinary skill in the art appreciates that various modifications and changes can be made without departing from the scope of the present disclosure. For example, features of different embodiments may be combined. For example, different affixment apparatuses may be combined, multiple holsters may be incorporated into a single integrated defense garment, and holsters having different layer seams, different smoothing apparatuses, and various different elements may be implemented. Accordingly, the specification is to be regarded in an illustrative rather than a restrictive sense, and all such modifications are intended to be included within the scope of the present disclosure.

Benefits, other advantages, and solutions to problems have been described herein with regard to various embodiments. However, the benefits, advantages, solutions to problems, and any elements that may cause any benefit, advantage, or solution to occur or become more pronounced are not to be construed as critical, required, or essential features or elements of the invention. Moreover, where a phrase similar to "at least one of A, B, and C" or "at least one of A, B, or C" is used in the claims or specification, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

As used herein, the singular forms "a," "an," and "the" include plural referents unless the context clearly dictates otherwise. As used herein, the terms "for example," "for instance," "such as," or "including" are meant to introduce examples that further clarify more general subject matter. Unless otherwise specified, these examples are embodiments of the present disclosure, and are not meant to be limiting in any fashion.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method of making an integrated defense garment comprising:

providing a holster comprising a defensive device retention apparatus, wherein the defensive device retention apparatus comprises:

forming a pocket with an inner and an outer layer, the pocket comprising a barrel pocket portion configured to receive a barrel of a firearm; a trigger pocket portion configured to receive a trigger guard of the firearm; a grip pocket portion configured to receive a grip of the firearm;

attaching an affixment apparatus to the defensive device retention apparatus, wherein the affixment apparatus comprises a first tab extending outwardly from an end edge of the barrel pocket portion; a second tab extending outwardly from a first side edge of the barrel pocket portion, the second tab further extending into a side edge of the trigger pocket portion; a third tab, a fourth tab, and a fifth tab each respectively extending outwardly from a first, second, and third side edge of the grip pocket portion; and a sixth tab extending outwardly from a second side edge of the barrel pocket portion, wherein each tab comprises distal convex curved edges curving away from corresponding distal convex curved edges of adjacent tabs;

integrating the holster, defensive device retention apparatus, and affixment apparatus to an undergarment comprising shapewear;

inserting the affixment apparatus in between first and second layers of the undergarment; and bonding the affixment apparatus to the undergarment.

2. The method according to claim 1, wherein the holster further comprises a smoothing apparatus comprising a stiffening layer outward of the defensive device retention apparatus to conceal a shape of the firearm.

3. An integrated defense garment comprising:

a holster comprising:

an affixment apparatus;

a defensive device retention apparatus, wherein the defensive device retention apparatus is connected to the affixment apparatus, and an undergarment comprising shapewear comprising a first layer and a second layer, wherein the defensive device retention apparatus comprises:

a pocket, the pocket comprising a barrel pocket portion configured to receive a barrel of a firearm;

a trigger pocket portion configured to receive a trigger guard of the firearm;

a grip pocket portion configured to receive a grip of the firearm;

wherein the affixment apparatus further comprises a first tab extending outwardly from an end edge of the barrel pocket portion; a second tab extending outwardly from a first side edge of the barrel pocket portion, the second tab further extending into a side edge of the trigger pocket portion; a third tab, a fourth tab, and a fifth tab each respectively extending outwardly from a first, second, and third side edge of the grip pocket portion; and a sixth tab extending outwardly from a second side edge of the barrel pocket portion, wherein each tab comprises distal convex curved edges curving away from corresponding distal convex curved edges of adjacent tabs; and wherein each tab is attached and located in between the first and second layers of the shapewear to integrate the holster into the undergarment.

* * * * *